US008235059B2

(12) United States Patent
Pires et al.

(10) Patent No.: US 8,235,059 B2
(45) Date of Patent: Aug. 7, 2012

(54) CONTAINER FOR POWDER PRODUCTS AND SCRAPER THEREFOR

(75) Inventors: Leo Clifford Pires, Basking Ridge, NJ (US); Roger Hwang, Maple (CA); Manisha Kohli, New Delhi (IN); Rahul Bose, New Delhi (IN); Abhisek Basak, New Delhi (IN)

(73) Assignee: Zen Design Solutions Limited, Kowloon (HK)

( * ) Notice: Subject to any disclaimer, the term of this patent is extended or adjusted under 35 U.S.C. 154(b) by 91 days.

(21) Appl. No.: 12/868,590

(22) Filed: Aug. 25, 2010

(65) Prior Publication Data

US 2011/0048443 A1 Mar. 3, 2011

Related U.S. Application Data

(60) Provisional application No. 61/237,285, filed on Aug. 26, 2009.

(51) Int. Cl.
*A45D 33/02* (2006.01)
*A45D 24/00* (2006.01)

(52) U.S. Cl. ..... 132/299

(58) Field of Classification Search ..... 132/298, 132/299, 306, 307; 401/4; 222/80, 342, 222/241, 327; 206/581, 572, 38; 209/379, 209/384, 385
See application file for complete search history.

(56) References Cited

U.S. PATENT DOCUMENTS

| | | | | |
|---|---|---|---|---|
| 1,582,125 | A * | 4/1926 | Clarke | 132/298 |
| 1,592,184 | A * | 7/1926 | Dodson | 132/296 |
| 1,642,780 | A * | 9/1927 | Kole et al. | 132/295 |
| 1,801,762 | A * | 4/1931 | Brun | 132/307 |
| 2,746,462 | A * | 5/1956 | Kasdan | 132/298 |
| 2006/0151355 | A1 * | 7/2006 | Oh | 206/581 |
| 2008/0251096 | A1 * | 10/2008 | Eng et al. | 132/294 |

* cited by examiner

*Primary Examiner* — Todd Manahan
*Assistant Examiner* — Niyati D Shah
(74) *Attorney, Agent, or Firm* — Patterson & Sheridan, LLP

(57) ABSTRACT

The present invention generally relates to containers for powder products. The present invention described herein relates to a container capable of generating powder in loose form. The invention further relates to cosmetic containers for powder products that present pressed and loose powder products for usage as per the convenience of user. Further the invention also relates to a scraper for such a container.

13 Claims, 11 Drawing Sheets

CONTAINER FOR POWDER PRODUCTS AND SCRAPER THEREFOR

CROSS-REFERENCE TO RELATED APPLICATION

This application claims benefit of U.S. Provisional Application Ser. No. 61/237,285, filed Aug. 26, 2009, which is incorporated by reference in its entirety.

BACKGROUND

1. Field of the Invention

Embodiments of the present invention generally relate to a container for powder products. The present invention described herein relates to a container capable of generating powder in loose form. The invention further relates to cosmetic containers for powder products that present pressed and loose powder products for usage as per the convenience of user. Further the invention also relates to a scraper for such a container.

The container of the present invention can be used to store a wide variety of powder cosmetic products.

2. Description of the Related Art

The cosmetic industry generally uses cosmetic containers to store cosmetic compositions. A conventional case has a base and a cover which is pivotally attached to the base in which is provided a receptacle to receive the cosmetic product therein. Powder cosmetic products are an important class of cosmetics which find application in a plurality of cosmetic uses. Generally these are available in two forms either pressed or loose. Loose powder and pressed powder can be used on different occasions and times. The loose powder is usually used when applying for the first time. The pressed powder is good when re-application of make-up is required or for just doing the touch-ups later on. Loose powder containers are generally bulkier while the pressed powder containers are available in a compact form. The biggest disadvantage with loose powder is the fact that it can be quite messy and the user can not carry it in her make-up case or purse. Since loose powder is not easy to carry, the user generally uses loose form at home before going out and carries the pressed powder with her for use during the day. A pressed powder compact is easy to carry around without fear of destroying your pocketbook or spilling the powder. As is evident, there is a place for both pressed powder and loose powder in a woman's make-up collection. Working together, they give a quick and convenient way to subtly enhance complexion.

As both these forms of powder would be required by a user during the day it is desirable that the user gets to use them as and when she wishes. Hence, the requirement for a single container capable of presenting loose powder and pressed powder as per user's convenience.

There have been attempts at making the container portable and at the same time make loose powder available to the user as per convenience. There are available pressed powder compacts that convert pressed to loose powder. Great Britain Patent No. 2,236,673 to Lir France discloses a powder compact containing a compacted powder receiving base, a lid and a scraper movable relative to the base for producing free loose powder.

A problem associated with the above package is that the user does not have access to the compacted powder. The user can only grind the pressed powder and use the resultant loose powder but is unable to access the pressed powder, thereby meaning that a separate pressed powder container would have to be carried for using pressed powder.

There has also been an attempt to provide access to the pressed powder in a compact that also delivers loose powder. In U.S. Pat. No. 7,503,331 to Eng et al. is disclosed a dual mode compact comprising a base member for storage of compressed powder, a lid cooperable with and receivable on the base member, a scraper member disposed adjacent the well of the base member and a finger-engageable means adjacent to the well of the base member, these being turnable thereon, and keying means connecting the scraper member to the finger-engageable means such that turning of the latter will impart corresponding rotary movement of the scraper member and consequent shaving of the upper surface of the cake to produce controlled quantities of cosmetic powder particulates therefrom. Further, the scraper member can be swung from a first position to a second position, this second position exposing the upper surface of the pressed product and enabling direct access to the pressed product.

However, the shortcoming of the above compact is that it causes unequal scraping of pressed powder and stops working after some usage which occurs due to the construction of the scraper and the finger-turnable engageable means in the compact. As the finger-engageable means always stays on the bulk the scraper member is able to scrape off the bulk present in the center, therefore, the periphery bulk would not be scraped and after some usages the scraper would not be able to scrape further as the periphery bulk remains at the top and a well is formed on which scraper would not be able to scrape.

Therefore, there is a need for a container that provides efficient conversion of pressed powder to produce loose powder. There is also a need for a container for generating loose powder that can give an indication to the user of the amount of the product remaining as the product is utilized. Also required is a container that can give the user an access to pressed powder and loose powder as per the requirement. Further, it is also desirable that the container is portable and provides a cleaner and user-friendly interface to reveal the products stored therein.

Further, the containers for generating loose powders generally comprise scrapers that convert pressed powder to loose powder for application by the user as per her convenience. These scrapers have scraping surfaces all over their surface to aid in scraping of the product, however, the problem associated is that these scraping surfaces are generally in the form of cut-outs that leave the product open for the dust, moisture & air to contaminate it thereby shortening the life of the product. Moreover, as these scrapers occupy whole area of the pan the user is unable to visually ascertain the freshness of the product within the pan.

A scraper, by virtue of its construction and milling surface design, leaves an uneven & loosened surface after it grates the surface. Such a loosened surface is undesirable as it is visually unpleasant. This uneven and loose surface is more prone to absorption as well loss of moisture (depending on the composition) as compared to a smooth and compact surface, thereby compromising the integrity of the bulk product.

Also, a metallic scraper, which is the material of choice for scrapers, is unable to show color to the buyer which is undesirable in a cosmetics package.

Hence, there is a need for a scraper that helps in insulation of the product from the outer environment. It is also desirable that the scraper be able to both scrape and smoothen, mill and compress the surface alternately. Showing color through such a grater will be an added advantage for the user.

SUMMARY

The present invention generally relates to containers for powder products. The present invention described herein relates to a container capable of generating powder in loose form. The invention further relates to cosmetic containers for powder products that present pressed and loose powder products for usage as per the convenience of user. Further the invention also relates to a scraper for such a container.

According to an embodiment of the invention there is provided a container that provides pressed and loose powder products in a single package to facilitate carrying and ready use and at the same time helping the user in choosing the desired form of product to be used.

According to an embodiment of the invention there is provided a container presenting pressed and loose powder products for usage as per the convenience of user.

According to an embodiment of the invention there is provided a container that is compact in form that can be easily carried in purse and at the same time gives the user an option of using either pressed or freshly milled loose powder as per the convenience and requirement of the user.

According to yet another embodiment of the invention there is provided a container that converts the pressed powder to loose powder efficiently and provides full evacuation of the product. Further, there is also provided a container that presents the pressed powder in a neat way to the user. The container of present invention is easy-to-use and does not create mess for the user.

In accordance with an embodiment of the invention the container comprises a cover, a base, a scraper and a system for engaging or disengaging the scraper with the base. The cover and base are connected by an attachment means in a manner permitting their relative movement with respect to one another to open and close the case. The attachment means may comprise a hinge, a pin, a snap, or a hook. The base may comprise of a lower base and an upper base, said lower and upper base being rotatably connected to each other. The upper base further comprises a receptacle for storing the powder product. The scraper is arranged to be selectively engageable with either the upper base or the cover by the aid of the system for engaging or disengaging the scraper. The lower base houses a biasing means that selectively biases the receptacle with the scraper. The system for engaging or disengaging the scraper with the base comprises a coupling means, a clamping means and an actuating means for actuating the system. The coupling means is connected with the cover and is arranged to be selectively engageable with the scraper. The clamping means is connected with the base and is arranged to be selectively engageable with the scraper. The clamping means is provided with such a profile that it is able to cooperate with complementary profiles present in the coupling means as well as in the scraper in order to keep the scraper and the coupling means clamped onto it selectively.

According to yet another embodiment of the invention the actuating means may alternatively be made to be an integral part of the coupling means.

According to yet another embodiment of the present invention a locking means is provided in the cover and base to prevent opening of the container when not in use. The locking means may comprise of a fastener piece on the cover that matches a fastener unit on the base for securing purpose. Further, a snap, a magnet or a button or any suitable locking means could be provided to secure the case.

In accordance with yet another embodiment of the present invention the actuating means may be a rotor, a button, a toggle switch, or a dialer.

According to yet another embodiment of the present invention the actuating means may be placed in any suitable position in the container such that it is easily accessible by the user such as it could be placed on either the cover or the base of the container or it could be placed in any other suitable position.

According to yet another embodiment of present invention the actuating means of the container may also serve as a guiding tool with mark indicia and provide additional information to the consumers thereby helping the user in selecting the product to be used. For example, the mark indicia on the actuating means could help in identification of the product by telling about the form of powder product available depending on its actuating position.

In accordance with yet another embodiment of the invention the cover may further comprise of a secondary cover such that the cover contains a cavity for receiving at least one cosmetic tool such as an applicator, a mirror or any suitable cosmetic tool. Alternatively, the secondary cover may contain another cosmetic product as well. The secondary cover may be operatively connected to the cover to open and close the secondary cover.

In accordance with yet another embodiment of the invention there may be provided a scraper holder for holding the scraper in place. The scraper holder is then arranged to be selectively engageable with the base. Also, alternatively a receptacle holder may be provided to keep the receptacle in place.

According to yet another embodiment of the invention during operation, the container may present itself in an open position in two conditions, one in which the scraper is available for scraping the powder product in the base and second in which the scraper is totally removed from the base and the pressed powder is accessible for usage. For making the scraper available for scraping the product in the base, the actuating means is actuated, while the container is closed, in such a manner that the scraper is disengaged with the coupling means and is engaged with the clamping means which keeps it clamped onto the base containing the receptacle. Therefore, when the container is opened i.e. the cover is unfastened, the scraper is available for the user to freshly mill the powder for application. Relative rotation of the upper base with the lower base causes the scraper to mill the product. The biasing means is in stressed condition when the scraper is engaged with the base as the scraper is sitting on the receptacle pushing the receptacle further down on the biasing means for efficient scraping action.

According to yet another embodiment of the invention during operation, for removing the scraper from the base, the cover is closed and then the actuating means is actuated so as to disengage the scraper with the clamping means and engage the scraper with the coupling means. The scraper when engaged with the coupling means gets connected to the cover, therefore, when the container is opened i.e. the cover is unfastened, the pressed powder product in the receptacle of the base is accessible while the scraper is engaged with the cover. When the scraper is not engaged with the base, the biasing means is in relaxed state and is not acting on the base.

In accordance with yet another embodiment of the invention the scraper aids in milling of the pressed powder product contained in the receptacle. The scraper has a suitable scraping profile on it wherein the profile may be a projection, a blade, a tooth or any other suitable profile. Further, the scraper may have any suitable shape and may occupy at least a section of the base for scraping the pressed product. The scraper may have any suitable cross-section and profile. Further, the container may be of any shape such as square, rectangular, circular polygonal or any suitable shape, such that the cover and the base having identical configuration of varying depths.

In accordance with yet another embodiment of the invention the container for powder product that presents pressed and loose powder products may be made to be airtight.

According to yet another embodiment of the invention there is provided a scraper for a container for generating powder product. There is further provided a scraper that scrapes and smoothens a surface.

According to yet another embodiment of the invention there is provided a scraper that mills and compresses the surface. There is also provided a scraper that helps in less absorption or loss of moisture of a formulation depending on the composition, for example if the composition of the product is such that it is hygroscopic in nature then such a scraper would help in lessening the moisture absorption when the product is exposed to the outer environment.

According to yet another embodiment of the invention there is provided a scraper that shows the color of the scraper beneath it thereby giving a better aesthetic appeal to the product being used by the user.

In accordance with another embodiment of the invention the scraper of the present invention comprises at least one scraping surface and at least one smoothening surface. The scraping surface comprises a suitable profile that causes milling of pressed powder. The scraping profile may be a projection, a blade, a tooth or any other suitable profile. Further, the scraper may have any suitable shape and may occupy at least a section of the base for scraping the pressed product. The scraper may have any suitable cross-section and profile. Further, the smoothening surface has a profile such that it is able to compress the loosened powder left just after scraping. The scraping surface and smoothening surface may be placed alternately in the scraper. The scraper may be of any suitable cross-section and profile and the milling and smoothening surface may occupy any proportion of the scraper. The scraping surface and smoothening surface may be different components joined together or they may be made integrally. Further, the material for scraping surface and smoothening surface may be any suitable polymeric material or any suitable metal. According to an alternative embodiment of the invention, the smoothening surface may be made transparent to show color of the product beneath it thereby helping the user know the integrity of the product being used by her. Alternatively both the scraping surface and smoothening surface may be made to be transparent.

In accordance with yet another embodiment of the invention there may be provided a scraper holder for holding the scraper in place.

In accordance with yet another embodiment of the invention during operation, as the user rotates the scraper for scraping the pressed powder beneath it, the scraped powder is disposed over it as loose powder while the uneven surface that is left immediately after scraping is smoothened by the smoothening surface. Also, the left over loose powder is compressed and compacted, making the powder less susceptible to outer environment.

There is provided a scraper that helps the product to retain its integrity and leaves a neater looking surface thereby giving the user an assurance of her product being fresh/uncontaminated.

These and further aspects which will be apparent to the expert of the art are attained by a container for powder products in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
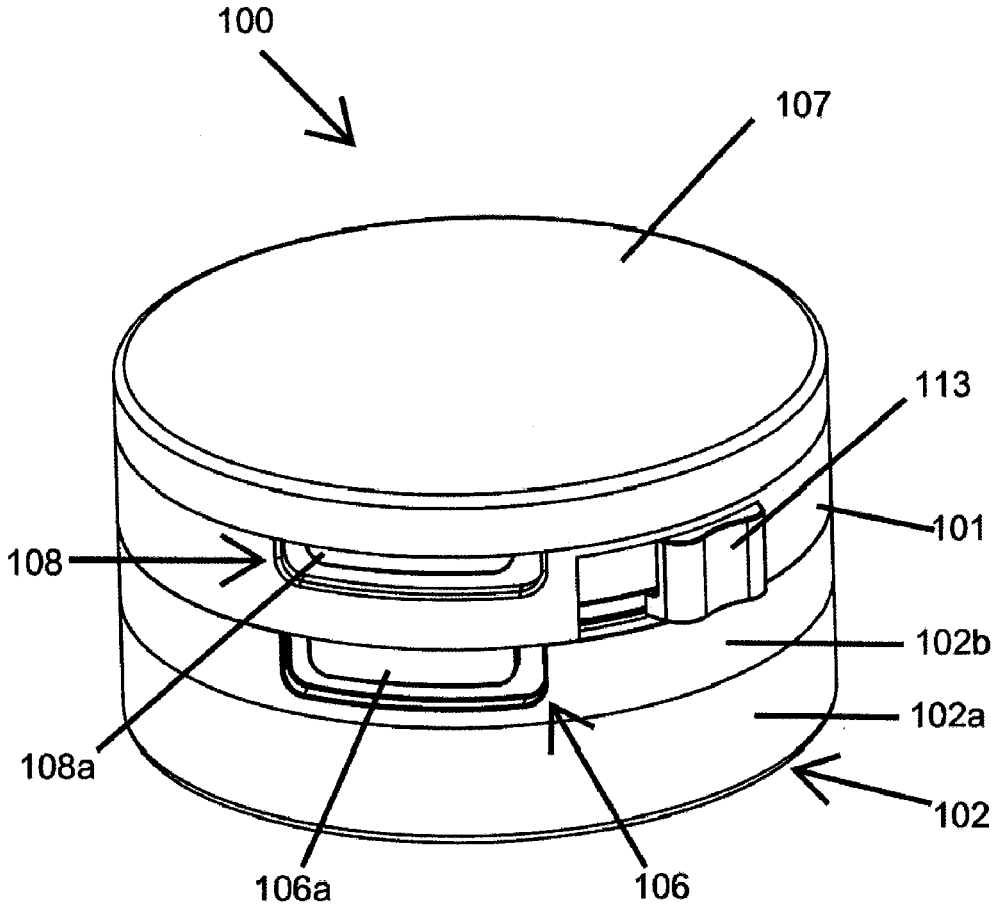
FIG. 1 is an isometric view of the container in closed condition according to one embodiment of the present invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

Figure 2:
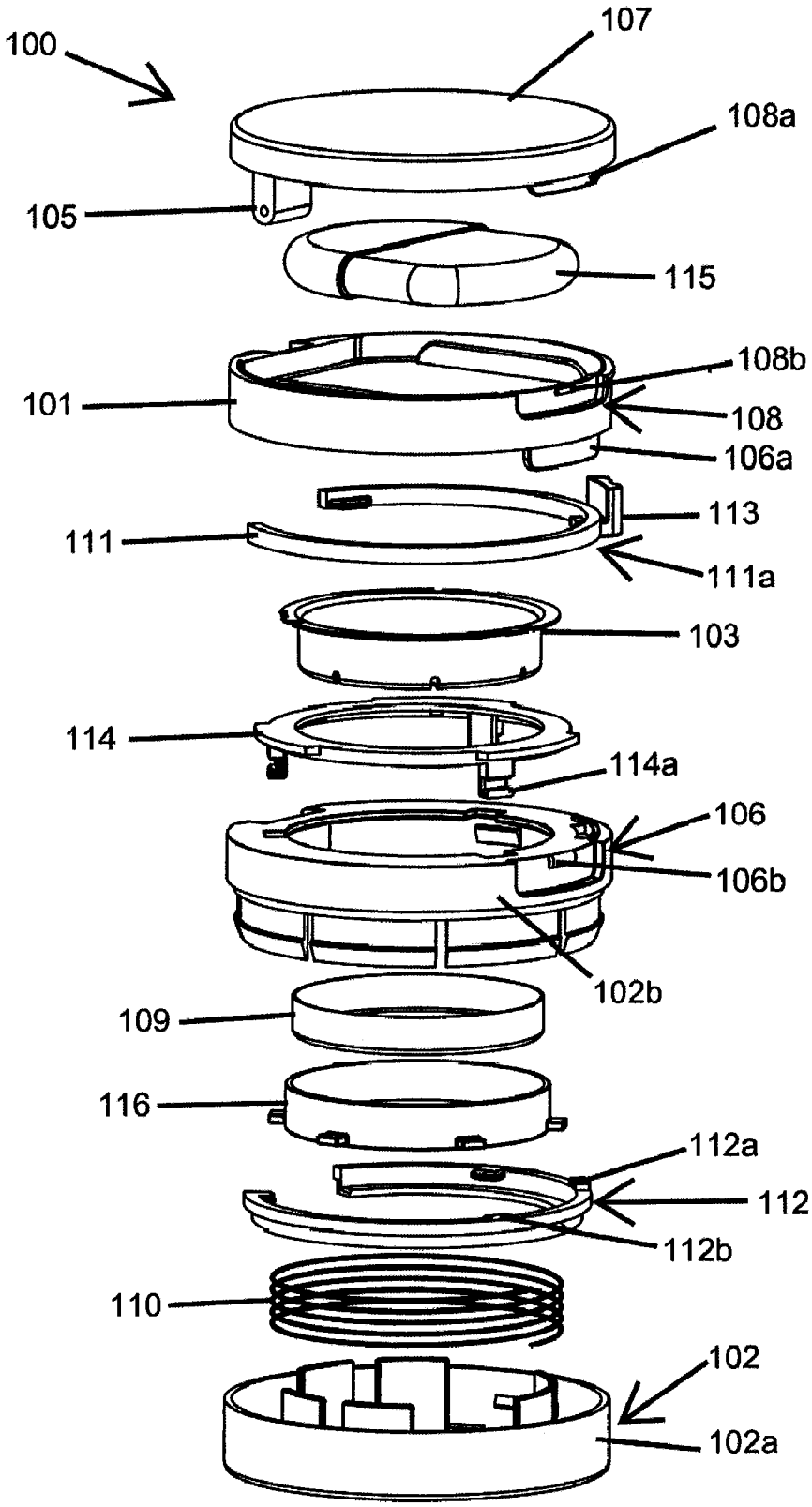
FIG. 2 is an exploded view of the container of FIG. 1.

FIG. 1 is one embodiment of the present invention showing a container 100 for powder products presenting pressed and loose powder products for usage as per the convenience of user. As represented by FIGS. 1 and 2, the container 100 comprises a cover 101, a base 102, a scraper 103 and a system for engaging or disengaging the scraper 103 with the base 102. The cover 101 and the base 102 have identical configurations of varying depth. In an alternative embodiment of the invention, the inside surface of the cover 101 may be provided with a reflector such as a mirror. There is also provided an attachment means 105 for connecting the base 102 and the cover 101 together in a manner permitting their relative movement with respect to one another to open and close the container 100. The attachment means 105 may be a hinge, a pin, a snap, or a hook. The container 100 further comprises a locking means 106 that comprises a fastener piece **106*a* on the cover 101 that matches a fastener unit 106*b* on the base 102. The locking means 106 protects exposure of consumer product to external environment when the container is closed. Further, the locking means 106 may alternatively be a snap, a magnet or a button or any other suitable locking means may be provided to secure the container 100. The cover 101 and base 102 may be formed of a suitable polymeric material such as acrylonitrile butadiene styrene or styrene acrylonitrile. Further, there is present a secondary cover 107 over the cover 101 as an optional feature such that the cover 101 contains a cavity for receiving at least one cosmetic tool 115 such as an applicator, a mirror or any suitable cosmetic tool. The secondary cover 107 may alternately house any suitable cosmetic product. The secondary cover 107 is operatively connected to the cover 101 to open and close the secondary cover 107. There is present a locking means 108 that comprises a fastener piece 108***a* on the secondary cover 107 that matches a fastener unit 108*b* on the cover 101. Further, the locking means may alternatively be a snap, a magnet or a button or any other suitable locking means may be provided to secure the secondary cover onto the cover. The secondary cover 107 may be formed of a suitable polymeric material such as acrylonitrile butadiene styrene or styrene acrylonitrile.

Figure 3:
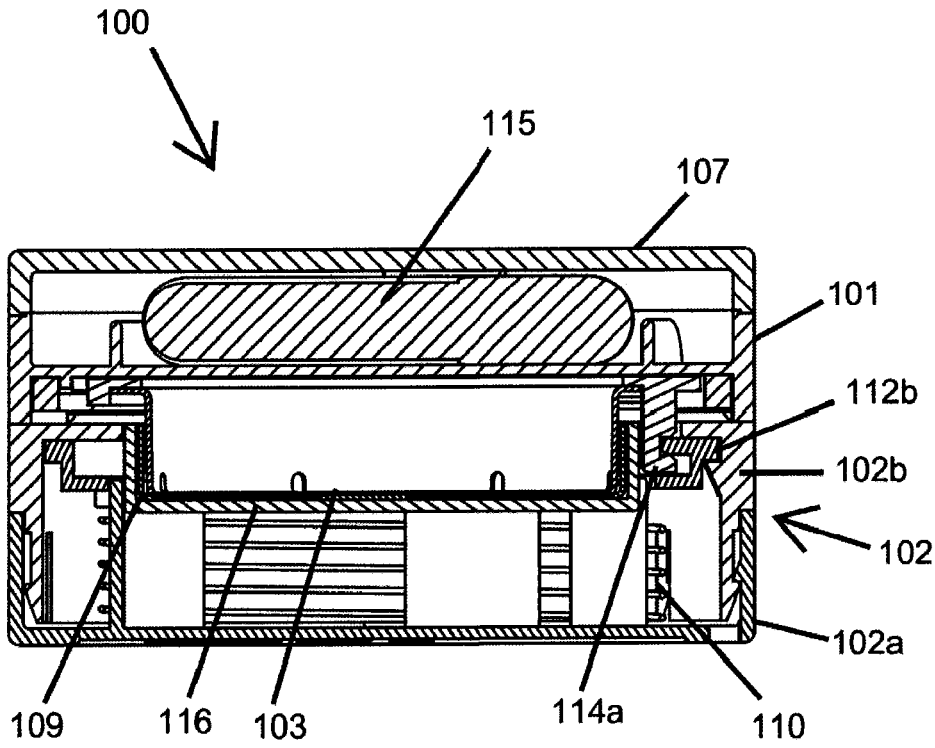
FIG. 3 is a cross-sectional view of the container of FIG. 1.

As illustrated by FIGS. 1, 2 and 3, the base 102 comprises of a lower base 102*a* and an upper base 102*b*, said lower 102*a* and upper base 102*b* being rotatably connected to each other. The upper base 102*b* further comprises a receptacle 109 for storing the powder product. Further, alternatively a receptacle holder 116 may be provided to keep the receptacle 109 in place. The scraper 103 aids in milling of the pressed powder product contained in the receptacle 109. The scraper 103 has a suitable scraping profile on it wherein the profile may be a projection, a blade, a tooth or any other suitable profile. The size and density of the scraping profiles may vary but are kept sufficient enough to produce required loose form of the powder. Further, the scraper 103 may have any suitable shape and may occupy at least a section of the base for scraping the pressed product. The scraper 103 is shown to be of a circular shape in the figures, however, the cross-section and profiles thereof are not limited to the same. The scraper 103 is arranged to be selectively engageable with either the upper base 102*b* or the cover 101 by the aid of the system for engaging or disengaging the scraper 103 with the base 102. The lower base 102*a* houses a biasing means 110 that selectively biases the receptacle 109 with the scraper 103. The system for engaging or disengaging the scraper 103 with the base 102 comprises a coupling means 111, a clamping means 112 and an actuating means 113 for actuating the system. The coupling means 111 is connected with the cover 101 and is arranged to be selectively engageable with the scraper 103 while the clamping means 112 is connected with the base 102 and is arranged to be selectively engageable with the scraper 103.

Further, the engagement and disengagement of the clamping means 112 with the coupling means 111 is caused by the actuating means 113. Furthermore, there is provided a scraper holder 114 for holding the scraper 103 in place. The scraper holder 114 is then arranged to be selectively engageable with the base 102. Alternatively the scraper holder 114 may be made integrally with the scraper 103. The clamping means 112 is provided with profiles 112*a* and 112*b* which cooperate with complementary profiles 111*a* and 114*a* present in the coupling means 111 and in the scraper holder 114 respectively in order to keep the scraper 103 and the coupling means 111 clamped onto it selectively as and when required. Further, as an alternative embodiment, the actuating means 113 may be made to be an integral part of the coupling means 111 as shown in the FIG. 2. The actuating means 113 as shown in figure represents a dialer, however, the actuating means may be a rotor, a button, or a toggle switch. Further, the actuating means 113 may be placed in any suitable position in the container 100 such that it is easily accessible by the user.

Figure 4:
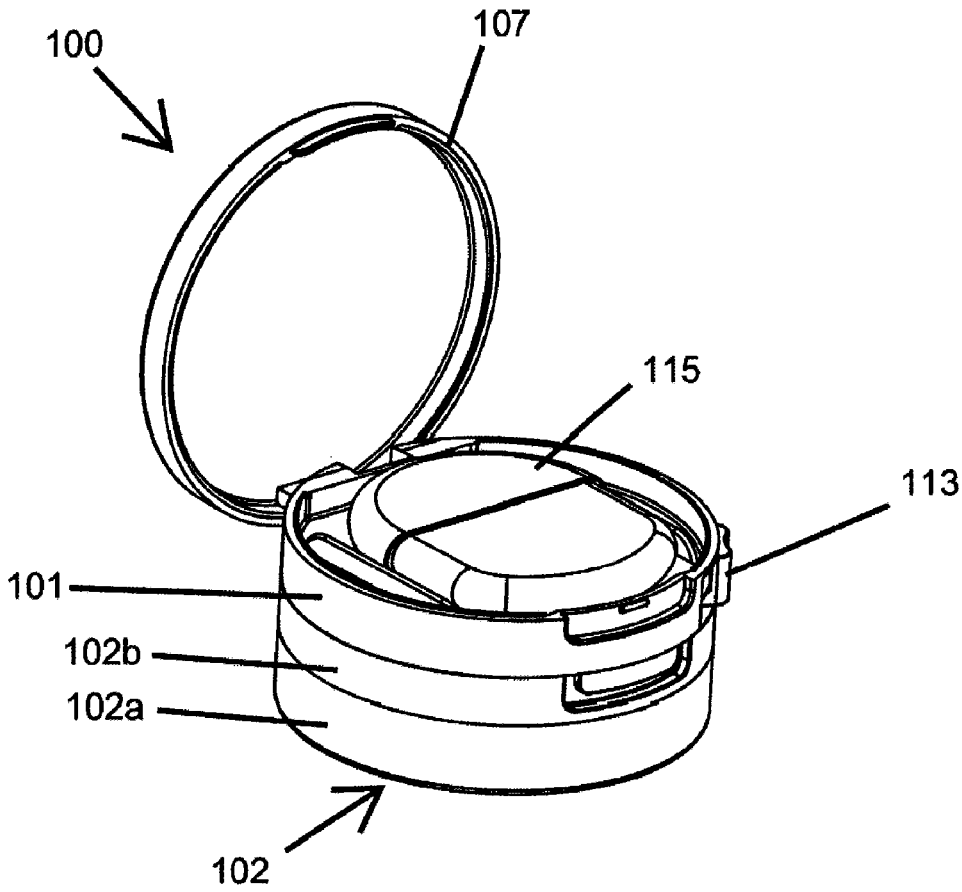
FIG. 4 illustrates an isometric view of the container of FIG. 1 showing the secondary cover in open position.

As illustrated by FIG. 4, the user may open the secondary cover 107 to access the cosmetic tool 115 for application of the product.

Figure 5:
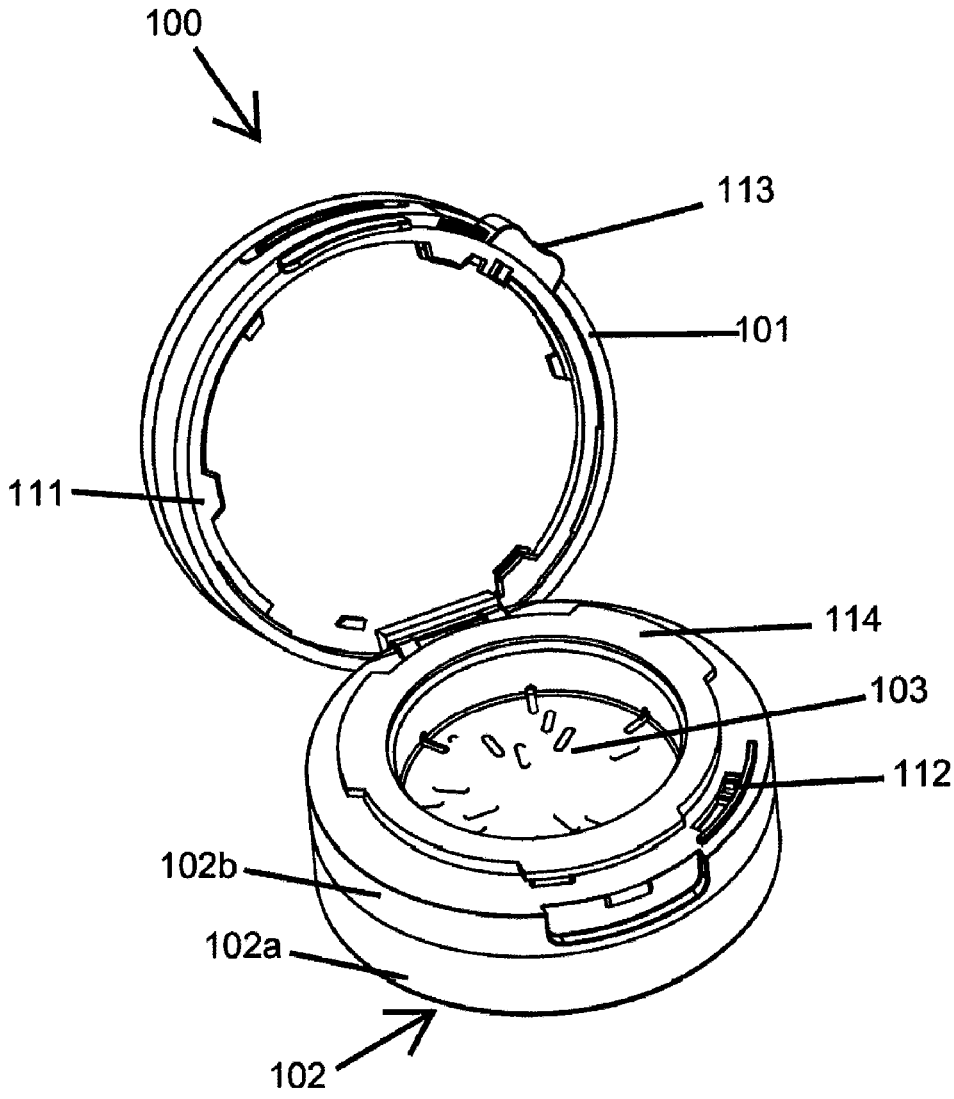
FIG. 5 illustrates an isometric view of the container of FIG. 1 showing the cover in open position and the scraper available in the base for milling of pressed powder according to one embodiment of the present invention.
Figure 6:
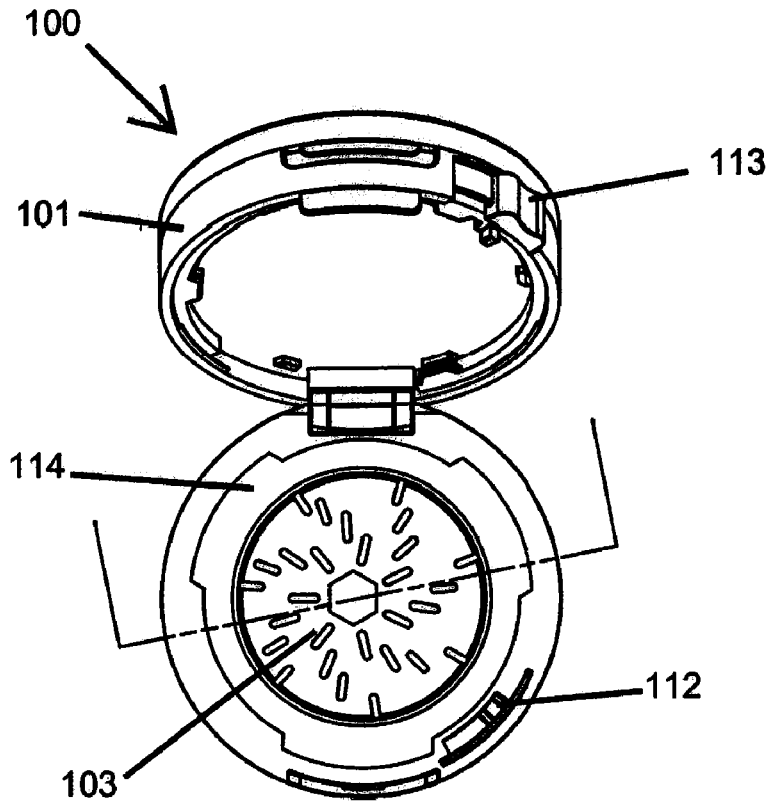
FIG. 6 represents an auxiliary view of the container of FIG. 5
Figure 7:
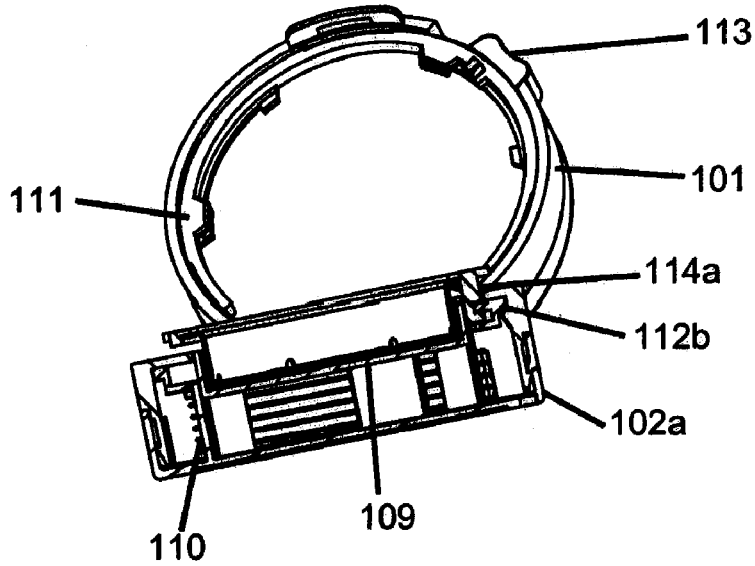
FIG. 7 shows a cross-sectional view of the case of FIG. 6.

When the user wishes to apply the product in loose powder form, he/she actuates the actuating means 113 in the closed container 100. When the actuating means 113 is actuated, it triggers the working of the system for engaging or disengaging the scraper 103 with the base 102 which facilitates the coupling of the scraper 103 with the upper base 102*b* and exposes the scraper 103 for milling the pressed powder to generate loose powder for application by the user. As can be seen in FIG. 3, the container 100 is in closed position wherein the profile 112*a* on the clamping means 112 has engaged the coupling means 111 while the profile 112*b* of clamping means 112 has engaged the profile 114*a* on the scraper holder 114. Further, as illustrated by FIGS. 5, 6 and 7, as the actuating means 113 is actuated, the coupling means 111 rotates and gets disengaged with the clamping means 112 as well as the scraper holder 114 and the profiles 114*a* on the scraper holder 114 remain engaged with the profile 112*b* on the clamping means 112 which keeps it clamped onto the upper base 102*b* containing the receptacle 109. Therefore, when the container 100 is opened i.e. the cover 101 is unfastened, the scraper 103 is available for the user to freshly mill the powder for application. Relative rotation of the upper base 102*b* with the lower base 102*a* causes the scraper 103 to mill the product. The biasing means 110 is in stressed condition when the scraper 103 is engaged with the upper base 102*b* as the scraper 103 pushes the receptacle 109 further down on the biasing means 110 for efficient scraping action.

Figure 8:
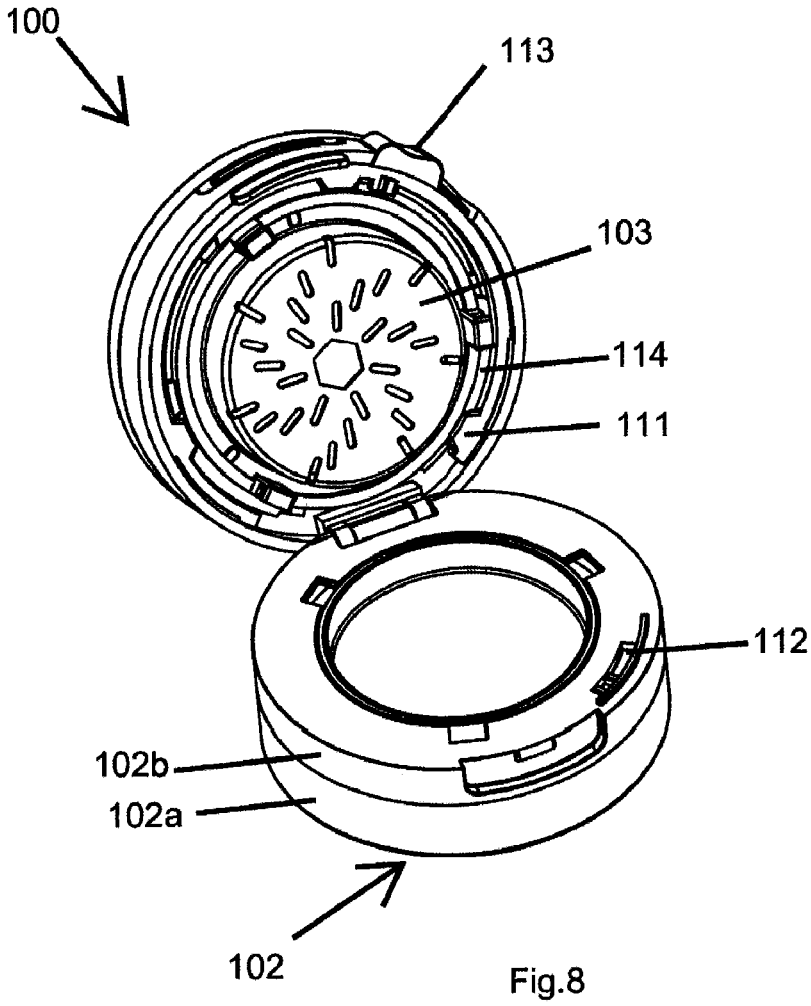
FIG. 8 is an isometric view of the container of FIG. 1 showing the cover in open position and the scraper totally removed from the base for accessing pressed powder according to an embodiment of the present invention.
Figure 9:
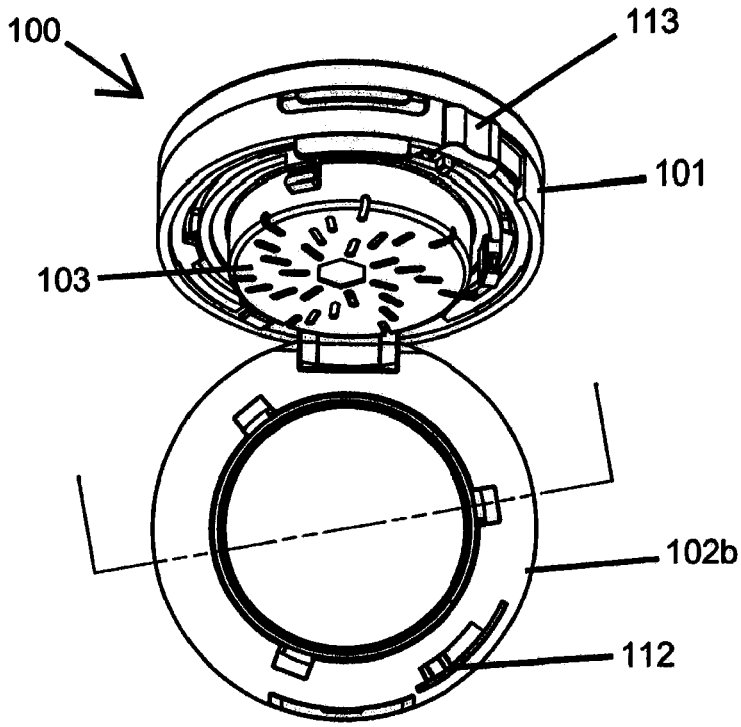
FIG. 9 represents an auxiliary view of the container of FIG. 8.
Figure 10:
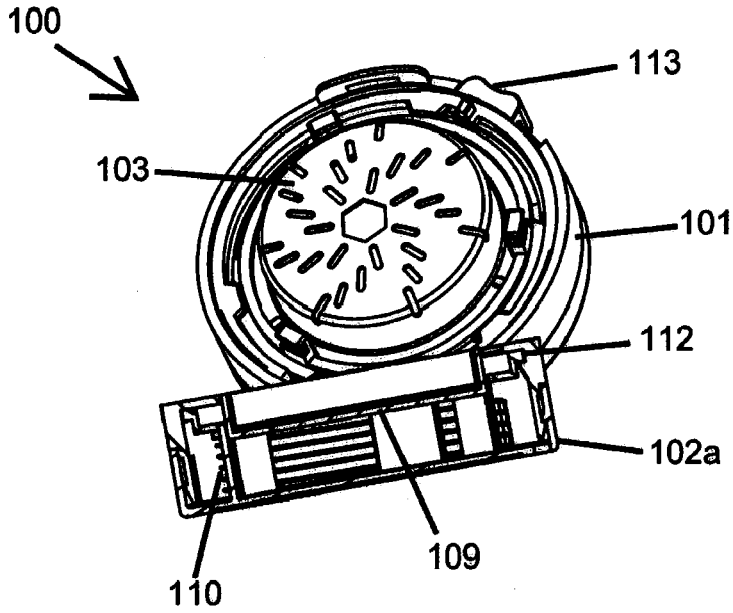
FIG. 10 shows a cross-sectional view of the case of FIG. 9.

When the user wishes to apply the product in pressed powder form, he/she actuates the actuating means 113 in the closed container 100. When the actuating means 113 is actuated, it triggers the working of the system for engaging or disengaging the scraper 103 with the base 102 which facilitates the disengagement of the scraper holder 114 with the upper base 102*b* and couples the scraper 103 with the cover 101 to expose the pressed powder for application by the user. As reflected by FIGS. 8, 9 and 10, as the actuating means 113 is actuated the clamping means 112 gets disengaged with the scraper holder 114, and simultaneously the coupling means 111 rotates and couples the scraper holder 114 hence the scraper 103 with itself. The scraper 103 when engaged with the coupling means 111 gets connected to the cover 101, therefore, when the container 100 is opened i.e. the cover 101 is unfastened, the pressed powder product in the receptacle 109 of the base 102 is accessible while the scraper 103 is engaged with the cover 101. When the scraper 103 is not engaged with the base 102, the biasing means 110 is in relaxed state and is not acting on the base 102.

All the components of the container 100 may be fabricated in a generally conventional manner using any suitable polymer material such as ABS, SAN, etc while any reflective material could be used as mirror. The material for biasing means and scraper may be any metal or any other suitable polymeric material.

The actuating means 113 of the container 100 may also serve as a guiding tool with mark indicia and provide additional information to the consumers thereby helping the user in selecting the product to be used. For example, the mark indicia on the actuating means could help in identification of the product by telling about the form of powder product available depending on its actuating position.

Although the above description and drawings show the container 100 being circular, the shapes and profile cross section thereof are not limited to the same. The container and accordingly the components of the container of the present invention may be of any suitable shape such as square, rectangular or polygonal.

Figure 11:
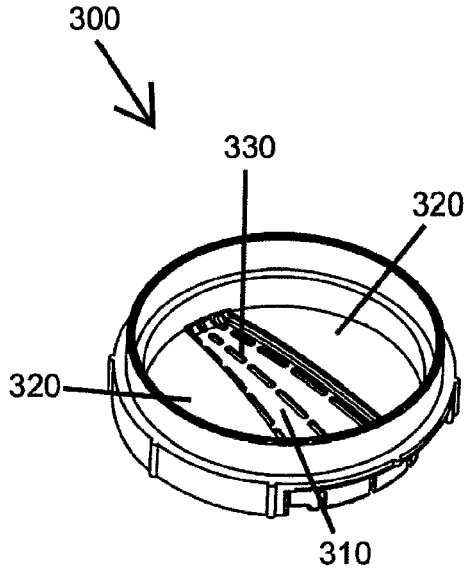
FIG. 11 is an isometric view of the scraper according to one embodiment of the present invention.
Figure 12:
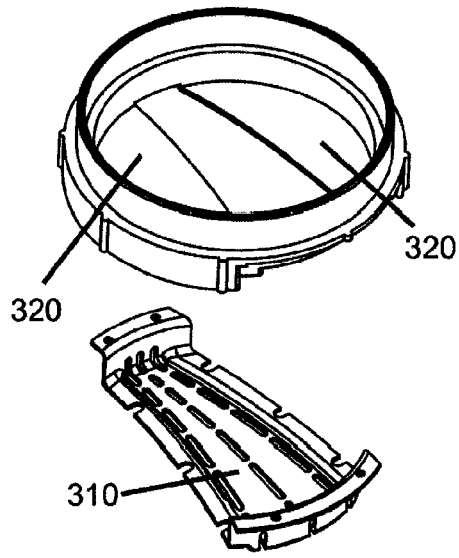
FIG. 12 is an exploded view of the scraper of FIG. 11.

FIG. 11 is one embodiment of the present invention showing a scraper 300 for a container for generating loose powder for usage as per the convenience of user. As represented by FIGS. 11 and 12 the scraper 300 comprises a scraping surface 310 and a smoothening surface 320. The scraping surface 310 comprises a scraping profile 330 that causes milling of pressed powder. The scraping profile 330 as shown is a cut-out, however, any suitable scraping profile may be present such as a projection, a blade, a tooth or any other suitable profile and may occupy at least a section of the scraper 300 for scraping the pressed product. Further, the scraper 300 is shown to be circular in the figures, however, the scraper 300 may have any suitable shape and cross-section. The scraping surface 310 as shown in FIGS. 11 and 12 occupies the central position, however, the scraping surface 310 may occupy any proportion of the scraper 300. Further, as shown in figures, the smoothening surface 320 has a planar profile, however, it may have any suitable profile such that it is able to compress the loosened powder left just after milling. Further, as an alternative embodiment, the scraping surface 310 and smoothening surface 320 may be positioned alternately in the scraper 300. The scraping surface 310 and smoothening surface 320 are shown in the FIGS. 11 and 12 to be different components joined together, however, they may be made integrally as well. Further, the material for scraping surface 310 and smoothening surface 320 may be any suitable polymeric material or any suitable metal. Furthermore, the smoothening surface 320 may be made transparent to show color of the product beneath it thereby helping the user know the integrity of the product being used by her. Alternatively both the scraping surface 310 and smoothening surface 320 may be made to be transparent.

During operation, as the user rotates the scraper 300 for scraping the pressed powder beneath it, the scraped powder is disposed over it as loose powder while the uneven surface that is left immediately after scraping is smoothened by the smoothening surface 320. Also, the left over loose powder is compressed and compacted, making the powder less susceptible to outer environment.

Figure 13:
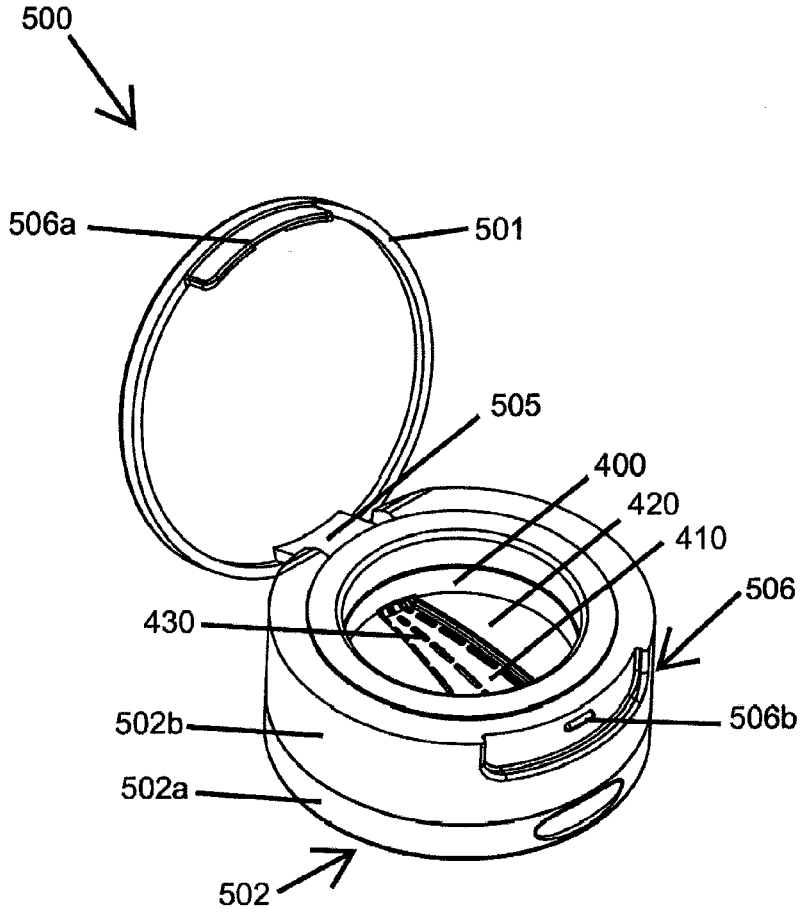
FIG. 13 is an isometric view of the container comprising the scraper according to one embodiment of the invention.
Figure 14:
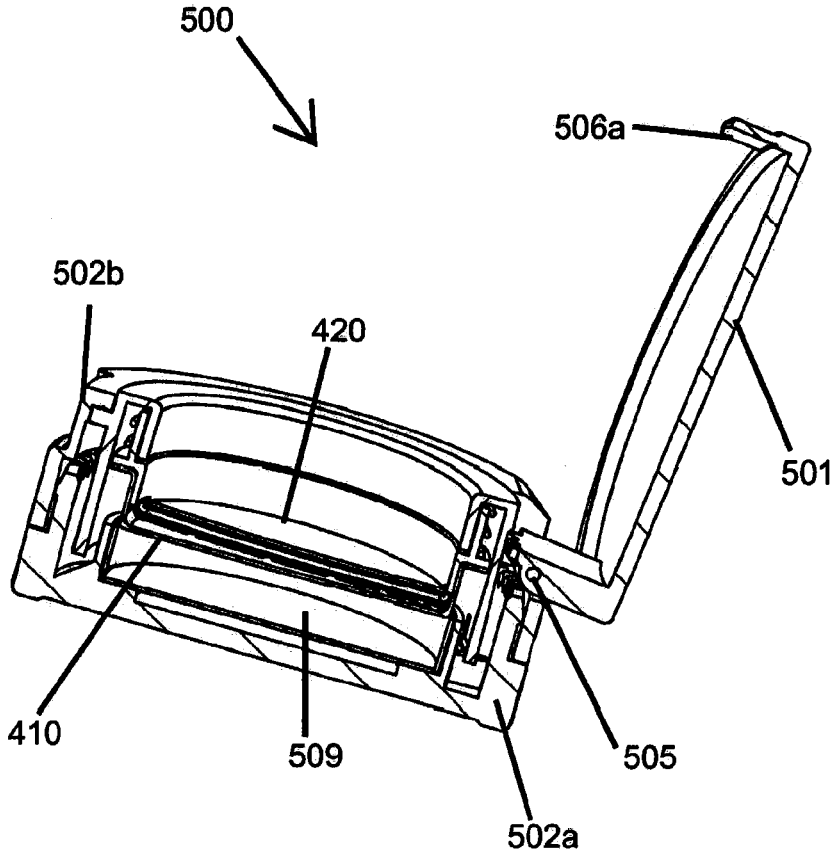
FIG. 14 is a cross-sectional view of the container of FIG. 13.

FIGS. 13 and 14 represent a container 500 comprising a scraper 400, The container 500 comprises a lid 501 and a base 502. The lid 501 and base 502 have identical configurations of varying depth. In an alternative embodiment of the invention, the inside surface of the lid 501 may be provided with a reflector such as a mirror. There is also provided an attachment means 505 for connecting the base 502 and the lid 501 together in a manner permitting their relative movement with respect to one another to open and close the container 500. The attachment means 505 may be a hinge, a pin, a snap, or a hook. The container 500 further comprises a locking means 506 that comprises a fastener piece 506*a* on the lid 501 that matches a fastener unit 506*b* on the base 502. The locking means 506 protects exposure of consumer product to external environment when the container is closed. Further, the locking means may alternatively be a snap, a magnet or a button or any other suitable locking means may be provided to secure the container 500. The lid 501 and base 502 may be formed of a suitable polymeric material such as acrylonitrile butadiene styrene or styrene acrylonitrile. As illustrated by FIGS. 13 and 14, the base 502 comprises of a lower base 502*a* and an upper base 502*b*, said lower 502*a* and upper base 502*b* being rotatably connected to each other. The pressed powder product is stored in a receptacle 509 beneath the scraper 400. The scraper 400 aids in milling of the pressed powder product contained in the receptacle 509. As the lower base 502*a* is rotated with respect to the upper base 502*b*, there is caused milling of the pressed powder by the scraper 400. The scraper 400 comprises a scraping surface 410 and a smoothening surface 420. The scraping surface 410 comprises a scraping profile 430 that causes milling of pressed powder. The scraping profile 430 as shown is a cut-out, however, any suitable scraping profile may be present such as a projection, a blade, a tooth or any other suitable profile and may occupy at least a section of the scraper 400 for scraping the pressed product. Further, the scraper 400 is shown to be circular in the figures, however, the scraper 400 may have any suitable shape and cross-section. The scraping surface 410 as shown in FIGS. 13 and 14 occupies the central position, however, the scraping surface 410 may occupy any proportion of the scraper 400. Further, as shown in FIGS. 13 and 14, the smoothening surface 420 has a planar profile, however, it may have any suitable profile such that it is able to compress the loosened powder left just after milling. As an alternative embodiment, the scraping surface 410 and smoothening surface 420 may be positioned alternately in the scraper 400. The scraping surface 410 and smoothening surface 420 may be different components joined together or they may be made integrally as well. Further, the material for scraping surface 410 and smoothening surface 420 may be any suitable polymeric material or any suitable metal. Furthermore, as shown in FIGS. 13 and 14, the smoothening surface 420 is made to be transparent to show color of the product beneath it thereby helping the user know the integrity of the product being used by her. Alternatively both the scraping surface 410 and smoothening surface 420 may be made to be transparent.

During operation, as the user rotates the lower base 502*a* relative to the upper base 502*b*, the scraper 400 scrapes the pressed powder beneath it, and the scraped loose powder is disposed over it while the uneven surface that is left immediately after scraping is smoothened by the smoothening surface 420. Also, the left over loose powder is compressed and compacted, making the powder less susceptible to outer environment.

All the components of the container 500 may be fabricated in a generally conventional manner using any suitable polymer material such as ABS, SAN, etc while any reflective material could be used as mirror. The material for scraper 400 may be any metal or any other suitable polymeric material. Although the above description and drawings show the container 500 being circular, the shapes and profile cross section thereof are not limited to the same. The container 500 and accordingly the components of the container 500 of the present invention may be of any suitable shape such as square, rectangular or polygonal.

While the foregoing is directed to embodiments of the present invention, other and further embodiments of the invention may be devised without departing from the basic scope thereof, and the scope thereof is determined by the claims that follow.

What is claimed is:

1. A container for powder products comprising:

a cover;

a base, the base comprising a lower base and an upper base, the lower base and the upper base being rotatably connected to each other and the upper base further comprising a receptacle for storing the powder product;

wherein the cover and the base are connected by an attachment means;

a scraper;

a system for engaging or disengaging the scraper with the base;

wherein the lower base houses a spring that selectively biases the receptacle with the scraper;

wherein the scraper is arranged to be selectively engageable with either the upper base or the cover by the aid of the system for engaging or disengaging the scraper with the base; and wherein the system for engaging or disengaging the scraper with the base comprises a coupler, a clamp, and an actuating means for actuating the system.

2. The container of claim 1 wherein the actuating means is made to be an integral part of the coupler.

3. The container of claim 1 wherein the cover further comprises of a secondary cover.

4. The container of claim 3 wherein the secondary cover comprises a cavity for receiving at least one cosmetic tool comprising an applicator, or a mirror.

5. The container of claim 3 wherein the secondary cover comprises a cavity for receiving a second cosmetic product.

6. The container of claim 3 wherein the secondary cover is operatively connected to the cover to open and close the secondary cover.

7. The container of claim 6 wherein the container further comprises a scraper holder for holding the scraper in place.

8. The container of claim 7 wherein the scraper holder is arranged to be selectively engageable with the upper base.

9. The container of claim 8 wherein the container further comprises a receptacle holder to keep the receptacle in place.

10. A method for using the container of claim 1 comprising:

a) scraping the powder product contained in the container wherein scraping comprises:

(i) actuating the actuating means while the container is closed such that the scraper is disengaged with the coupler and is engaged with the clamp which keeps it clamped onto the base containing the receptacle, (ii) unfastening the cover to make the scraper available for the user to freshly mill the powder product for application, (iii) rotating the upper base relative to the lower base to cause the scraper to scrape the powder product b) using the powder product contained in the container comprising:

(i) actuating the actuating means while the container is closed such that the scraper is disengaged with the clamp and is engaged with the coupler in the cover, (ii) unfastening the cover to make the powder product is accessible in the receptacle of the base while the scraper is engaged with the cover.

11. The container of claim 1 wherein the container is made to be airtight.

12. A container for powder products comprising:

a cover;

a base, the base comprising a lower base and an upper base, the lower base and the upper base being rotatably connected to each other and the upper base further comprising a receptacle for storing the powder product;

wherein the cover and the base are connected by an attachment means;

a scraper;

a system for engaging or disengaging the scraper with the base;

wherein the lower base houses a spring that selectively biases the receptacle with the scraper;

wherein the scraper is arranged to be selectively engageable with either the upper base or the cover by the aid of the system for engaging or disengaging the scraper with the base;

wherein the system for engaging or disengaging the scraper with the base comprises a coupler, a clamp, and an actuating means for actuating the system; and wherein the coupler is connected with the cover and is arranged to be selectively engageable with the scraper and wherein the clamp is connected with the base and is arranged to be selectively engageable with the scraper.

13. A container for powder products comprising:

a cover;

a base, the base comprising a lower base and an upper base, the lower base and the upper base being rotatably connected to each other and the upper base further comprising a receptacle for storing the powder product;

wherein the cover and the base are connected by an attachment means;

a scraper;

a system for engaging or disengaging the scraper with the base;

wherein the lower base houses a spring that selectively biases the receptacle with the scraper;

wherein the scraper is arranged to be selectively engageable with either the upper base or the cover by the aid of the system for engaging or disengaging the scraper with the base;

wherein the system for engaging or disengaging the scraper with the base comprises a coupler, a clamp and an actuating means for actuating the system;

wherein the coupler is connected with the cover and is arranged to be selectively engageable with the scraper and wherein the clamp is connected with the base and is arranged to be selectively engageable with the scraper; and wherein the clamp comprises a profile that cooperates with a complementary profile present in the coupler as well as in the scraper in order to keep the scraper and the coupler clamped onto it selectively.

* * * * *